United States Patent [19]

Oakes

[11] 4,140,988

[45] Feb. 20, 1979

[54] ELECTRIC FUSE FOR SMALL CURRENT INTENSITIES

[75] Inventor: Richard T. Oakes, Newburyport, Mass.

[73] Assignee: Gould Inc., Rolling Meadows, Ill.

[21] Appl. No.: 821,771

[22] Filed: Aug. 4, 1977

[51] Int. Cl.[2] ..... H01H 85/44

[52] U.S. Cl. ..... 337/279; 337/297

[58] Field of Search ..... 337/186, 290, 296, 297, 337/279, 273

[56] References Cited

U.S. PATENT DOCUMENTS

| | | | |
|---|---|---|---|
| 3,291,939 | 12/1966 | Hitchcock | 337/279 |
| 3,585,556 | 6/1971 | Hingovany | 337/297 |
| 3,913,051 | 10/1975 | Manken et al. | 337/279 |

*Primary Examiner*—George Harris

[57] ABSTRACT

An electric fuse having a printed circuit type fusible element. A substrate of glass textile material impregnated with a polymerized melamine resin and alumina trihydrate is the carrier for the fusible element. The dispersion of the two above referred-to components is formulated to serve as adhesive medium between the glass textile material and its metal covering and as source of arc-quenching gases when subjected to the action of an electric arc. An addition of silane significantly enhances the bonding action of the melamine resin alumina trihydrate dispersion of the glass fiber substrate with the metal layer by which it is clad.

8 Claims, 3 Drawing Figures

ELECTRIC FUSE FOR SMALL CURRENT INTENSITIES

BACKGROUND OF THE INVENTION

Fuses according to this invention are particularly suited for low amperage ratings in the order of few amps., due to the thin metal foils used as fusible elements. However, fuses embodying this invention are not limited to said amperage ratings because several printed circuit type fusible elements may be connected in parallel. Printed circuit boards have been used for many years and the techniques of making them are well know. However, unlike conventional printed circuits which carry extremely small currents in the neighborhood of microamps., the subject-matter of the present invention is intended to carry currents of the above referred-to order and ought to be capable of extinguishing arcs caused by the fusing of the metal layer.

It is an object of this invention to provide fusible elements capable of carrying currents in the order of a few amps. and to produce arc-extinguishing gas blasts.

It is further an object of this invention to provide an arc-quenching gas-evolving resin which additionally serves as an effective adhesive to join the components of metal glass substrates.

Still another object of this invention is to impart dimensional stability to fusible elements which otherwise could not be handled.

SUMMARY OF THE INVENTION

Fuses embodying the present invention include a tubular casing of electric insulating material and a granular arc-quenching filler material therein. A substance of glass fibers is immersed in said filler and clad by a conductor of sheet metal. This conductor forms the current carrier and is provided with means for connecting it into an electric circuit, e.g. ferrules mounted on said casing. The above substrate is saturated with an aqueous dispersion of melamine resin and alumina trihydrate to perform the dual function of bonding said substrate to said conductor of sheet metal and of evolving arc-extinguishing gases when subjected to the action of an electric arc. Included in said dispersion is a small quantity of organo functional silane in the order of 1%-5% by weight of the melamine solids contained in said dispersion. The addition of silane greatly increases the bonding action between the glass and the metal components of the device.

DESCRIPTION OF PREFERRED EMBODIMENT

Figure 1:
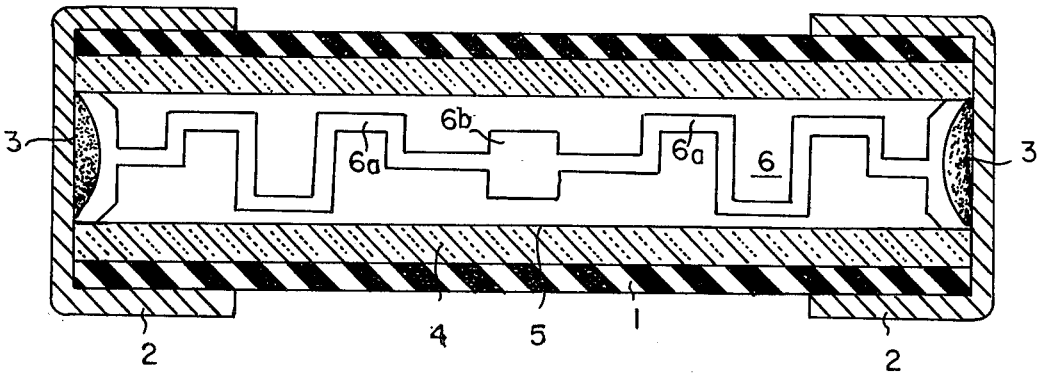
FIG. 1 is a top plan view showing a fuse embodying the invention.

In FIG. 1 numeral 1 refers to a tubular casing of electric insulating material with ferrules 2 located on opposite ends thereof and effectively sealing said casing. Numeral 3 are blind solder joints conductively interconnecting ferrules 2 with fusible overlay or fusible element 6. The metallic overlay 6 includes the heater portions 6*a* and the low current interrupting portion 6*b* which may be formed by a tin layer on the copper layer 6 and a silver layer on the tin layer. Casing 1 is filled with a granular arc-quenching filler material 4 which embeds the glass fiber substrate 5 therein.

Figure 2:
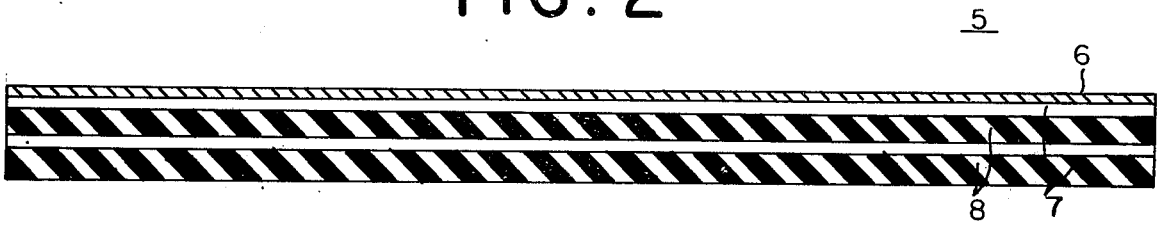
FIG. 2 is a section on a larger scale through the substrate showing the arrangement of the different layers thereof.

FIG. 2 shows a section of the substrate 5 embodying this invention. Said substrate may be of variable thickness depending on the amount of gas-evolving material required, the bonding strength required, and how much of a heat sink the substrate is required to be. Numeral 6 refers to a metal layer from which the fusible element is etched. The process of photochemical etching is known to those skilled in the art and is only briefly mentioned here for that reason. Numeral 7 refers to interfacial layers of thermosetting resin serving to hold the plies of substrate together and provide a source of arc-extinguishing gas. Numeral 8 refers to layers of glass textile material which can be either woven glass cloth, or non-woven glass fiber mat, or a combination of the two.

Figure 3:
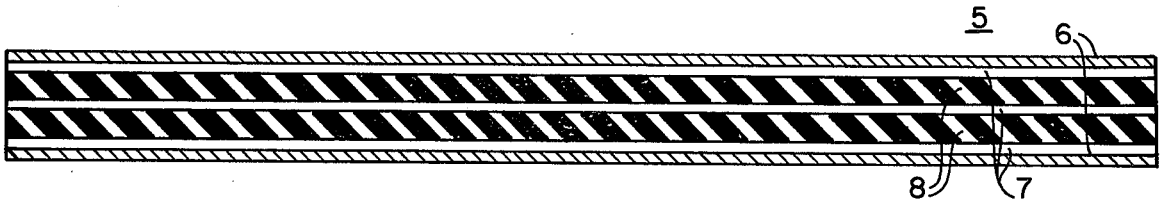
FIG. 3 is a section through a substrate showing two layers of sheet metal sandwiching layers of glass fiber material.

FIG. 3 shows a section through an alternative form of the substrate 5. Numeral 6 refers to two separate metal layers. from which the fusible elements are etched, sandwiching alternating layers of resin 7 and glass fibers 8. The metal layers 6 are connected in parallel at points 3 thereby providing a device capable of carrying current, depending upon the number of elements etched on the respective surfaces thereof, which is a multiple of that carried by a substrate of the same element configuration and being metal clad on but one side.

The resin 7 is specifically formulated for the above referred-to dual purpose. It consists of an aqueous dispersion of melamine formaldehyde and alumina trihydrate. The aqueous depression may have a solids content of from 20%-45% melamine-formaldehyde resin and from 50%-75% alumina trihydrate. The exact formulation largely depends among other things on the amount of resin required to effectively bond any particular thickness of metal foil. These are the active gas producing constituents with nitrogen gas coming off the cyclic melamine ring structure on exposure to arc heat and water of hydration as steam coming off the alumina trihydrate on exposure to heat from an arc. The melamine formaldehyde will evidence will evidence tracking following release of its nitrogen, however, when alumina trihydrate loses its water of hydration, aluminum oxide ($A1_20_3$) remains which in sufficient quantities effectively eliminates tracking by catalytically promoting the oxidation of carbonaceous material.

A small quantity of an organo-functional silane is added to the resin dispersion because of its ability to greatly facilitate bonding of organic polymer systems to inorganic substrates an amount in the order of from 1%-5% by weight of the melamine solids has been found to be satisfactory.

A small quantity of a low molecular weight alcohol, e.g. butyl alcohol, is also added in the range of 1%-10% by weight of the weight of melamine solids to promote a faster cure.

The resin is thoroughly mixed with the alumina trihydrate in an aqueous medium until a homogenous dispersion, i.e. an organosol is achieved. The aqueous melamine in which the solids are depressed is an amount ranging from 15%-25% by weight of the total solids content being used. Then some silane and some low molecular alcohol are added to the dispersion. The layers of glass textile material are then saturated with the above dispersion, the metal layer applied, and both pressed together. A pressure of 200-300 pounds per square inch. Polymerization is accomplished by uniformly heating the substrate under pressure preferably between 280°-315° F. Following polymerization the substrate is ready to have the particular fusible element photochemically etched from the metal layer.

I claim as my invention:

1. An electric fuse comprising
   a. a tubular casing of electric insulating material;
   b. a granular arc-quenching filler inside said casing;
   c. a substrate of glass fibers immersed in said filler and clad by a conductor of sheet metal;
   d. means for connecting said conductor into an electric circuit;
   e. an aqueous dispersion of melamine resin and alumina trihydrate saturating said substrate to perform the dual function of bonding said substrate to said conductor of sheet metal and of evolving arc-extinguishing gases when subjected to the action of an electric arc; and
   f. said dispersion further including a small addition of organo-functional silane in the order of 1%-5% by weight of the melamine solids contained in said dispersion.

2. An electric fuse as specified in claim 1 wherein a small addition of a low molecular weight alcohol is added to said dispersion in the order of 1%-10% by weight of said melamine content thereof.

3. An electric fuse as claimed in claim 1 wherein said substrate comprises at least one ply of woven glass cloth.

4. An electric fuse as claimed in claim 1 wherein said substrate comprises at least one ply of glass fiber mat.

5. An electric fuse as claimed in claim 1 wherein said substrate comprises two layers of sheet metal sandwiching said substrate of glass fibers.

6. An electric fuse as claimed in claim 1 wherein said aqueous dispersion of melamine is an organosol with a solids content of between 28%-45% of melamine formaldehyde resin, 50%-67% alumina trihydrate, 1%-5% of silane by weight of the melamine solids content of said dispersion, the dispersing vehicle being water in the amount of 15%-20% by weight of the total weight of solids.

7. An electric fuse as claimed in claim 1 wherein said dispersion has a solid content of between 20%-40% melamine formaldehyde resin and between 50%-75% alumina trihydrate dispersed in an aqueous medium of between 15%-25% by weight of the total of said solids content of said dispersion.

8. A method of making a composite substrate for supporting fusible elements of electric fuses which comprises the steps of
   a. saturating at least one glass textile layer with an aqueous dispersion of melamine formaldehyde resin, alumina trihydrate and silane;
   b. depositing at least one metal layer onto said glass textile layer;
   c. compressing said glass textile layer and said metal layer to a pressure ranging from 200-300 pounds per square inch; and thereafter
   d. thermally polymerizing said dispersion at a temperature between 280° F-315° F.

* * * * *

UNITED STATES PATENT AND TRADEMARK OFFICE

CERTIFICATE OF CORRECTION

PATENT NO. : 4,140,988
DATED : February 20, 1079
INVENTOR(S) : Richard T. Oakes

It is certified that error appears in the above-identified patent and that said Letters Patent are hereby corrected as shown below:

Column 1, line 33, "substance" to -- substrate --.

Column 2, line 32, "depression" to -- dispersion --.

line 42, delete "will evidence", first occurrence line 61, "depressed" to -- dispersed --.

line 68, after "inch." insert -- inch has been found to work with an optimum around 275 pounds per square inch. --.

Column 1, line 17, after "currents" insert -- in excess --.

Column 2, line 2, after "6" "and a silver layer on the tin layer." to read -- or a tin layer on a silver layer. --.

line 64, after "molecular" insert -- weight --.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*